US006510832B2

(12) United States Patent
Maurer et al.

(10) Patent No.: US 6,510,832 B2
(45) Date of Patent: Jan. 28, 2003

(54) CONTROLLABLE AIR INTAKE SYSTEM FOR AN INTERNAL COMBUSTION ENGINE AND CONTROL PROCESS THEREFOR

(75) Inventors: Hermann Maurer, Oberstenfeld (DE); Klaus Waltenberg, Murr (DE); Alfred Sadlauer, Ernsthofen (AT); Georg Novotny, Steyr/Gleink (AT)

(73) Assignees: Filterwerk Mann & Hummel GmbH, Ludwigsburg (DE); Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/983,824

(22) Filed: Oct. 26, 2001

(65) Prior Publication Data

US 2002/0083916 A1 Jul. 4, 2002

(30) Foreign Application Priority Data

Oct. 26, 2000 (DE) ..... 100 53 146

(51) Int. Cl.[7] ..... F02B 77/00
(52) U.S. Cl. ..... 123/198 E; 180/68.3
(58) Field of Search ..... 123/198 E; 180/68.3; 55/385.3

(56) References Cited

FOREIGN PATENT DOCUMENTS

DE 3736777 * 12/1988 ..... 123/198 E

* cited by examiner

*Primary Examiner*—Noah P. Kamen
(74) *Attorney, Agent, or Firm*—Crowell & Moring LLP

(57) ABSTRACT

An intake system for an internal combustion engine to avoid water intake, which includes a main air inlet (10), an auxiliary air inlet (11), and an air filter (12). In the main air inlet (10) there is a valve 16 to sealingly close the main air inlet (10) and a moisture sensor (15), which is connected so as to communicate with an evaluator (22) which, in turn, is connected to at least one other sensor (23) disposed outside the intake system and provided to detect other functions. Examples of possible other sensors (23) include rain sensors and/or temperature sensors. The sensor signals are coupled and or correlated in the evaluator (22), and in accordance with a logic which resides in the evaluator (22), a control signal is produced that opens or closes the main air inlet (10) by means of the valve (16), which can be moved into the respective open or closed positions by any of a number of diverse types of drives, such as, electrical, pneumatic, or electro-pneumatic drives.

14 Claims, 2 Drawing Sheets

CONTROLLABLE AIR INTAKE SYSTEM FOR AN INTERNAL COMBUSTION ENGINE AND CONTROL PROCESS THEREFOR

BACKGROUND OF THE INVENTION

The invention relates to a controllable air intake system for an internal combustion engine of a motor vehicle and to a process for controlling such an air intake system.

Published Japanese patent application no. JP 57-135 256 discloses an intake system, which has a main air inlet, an auxiliary air inlet and a water sensor. The water sensor is disposed in a container, in which water can collect. As soon as the container is filled with water and water penetrates into the main air inlet, the water sensor detects this and sends a signal to close the main air inlet by means of a valve disposed in the main air inlet. The valve is designed in such a manner that it opens the auxiliary air inlet when the main air inlet closes.

The drawback with this design is that water has to collect in the container so that the water sensor switches. In doing so, condensate from the components adjacent to the intake system can collect, for example, in the container and fill the container with the result that the water sensor sends a signal without there being any possibility of water intake. Furthermore, the filling of the container with water can take too long, for example in the case of splash water, so that the valve closes the main air inlet too late. Water that has collected once in the container causes the valve to close, even when there is no more water present in the vicinity. Thus, this control of the valve is inaccurate and unreliable.

SUMMARY OF THE INVENTION

It is therefore an object of the present invention to provide an intake system that exhibits reliable and accurate control in order to avoid water intake. This and other objects are achieved by the invention as described and claimed hereinafter.

The intake system of the invention is appropriate in an advantageous manner to take in air for an internal combustion engine and to prevent the intake of water which is detrimental to the internal combustion engine. This intake system is suitable for all types of internal combustion engines with the most diverse applications, in particular for internal combustion engines in motor vehicles.

The intake system exhibits a main air inlet for raw or unfiltered air, which, on the one hand, has an opening, and, on the other hand, is connected so as to communicate with an air filter. A clean air line, which is connected so as to communicate with the internal combustion engine, is connected on the downstream side to the air filter. Between the opening and the air filter there can be various components, which improve, for example, the acoustics of the intake system or fulfill other functions. The opening, through which air is drawn in from the environment, is arranged at an advantageous location for air intake. Preferably cool, oxygen-containing air, which has a beneficial effect on the combustion in the internal combustion engine, can be drawn in at this advantageous location for air intake. In a motor vehicle this advantageous location for air intake can be arranged, for example, in the front area, in particular behind the cooler.

A moisture sensor, which detects moisture, in particular water, entering the main air inlet, is arranged in the main air inlet. In this respect, the moisture sensor can be designed in such a manner that as soon as there is a spray of water, for example, produced by a passing vehicle, or not until water impact, produced by fording (i. e., driving through) a stream of water, does it send the signal "water in the main air inlet" to the evaluating unit. In such case, the moisture sensor is dimensioned as a function of the required sensitivity. The moisture sensor has a signal output, which is connected so as to communicate with an evaluating unit. In this respect, the connection between the signal output and the evaluating unit can be effected directly, for example, by a cable, an infrared interface, radio or indirectly by interconnected components such as control electronics or signal amplifiers. The connection transfers the signal of the moisture sensor to the evaluating unit, with the fastest possible signal transmission being advantageous. At startup of the internal combustion engine the functionality of the moisture sensor can be tested and a control signal can be emitted.

The evaluating unit is connected so as to communicate with at least one other sensor, which is arranged outside the intake system and is provided to detect other functions, not directly related to the intake system. Switching logic can be produced in the evaluating unit by means of the signal of the moisture sensor in connection with the signal of the other sensor, which is disposed outside the intake system. The signal of the moisture sensor can, for example, be confirmed or negated by the signal of the external sensor when this other sensor can also detect water. Other sensors, which detect environmental conditions other than the presence or absence of moisture, can accelerate or decelerate, for example, the closing of the main air inlet. As a function of the switching logic, defined in the evaluating unit, a control signal is emitted. The functionality of the sensor, arranged outside the intake system, can be tested, for example, at startup of the internal combustion engine, and a corresponding control signal can be emitted.

A valve, which can completely close the main air inlet when moisture or water enters, is moveably arranged in the main air inlet. This valve is connected so as to communicate with the evaluating unit. The connection between the valve and the evaluator can be effected directly, for example, by means of a cable, an infrared interface, or radio or indirectly by means of interconnected components, such as control electronics or signal amplifiers. The control signal emitted by the evaluating electronics, induces, for example, fast, slow or partial closing of the main air inlet by means of the valve, which can be constructed, for example, as a rotary disk valve, or as a one-part part or multi-part flap. To move the valve, various types of drives, such as pneumatic, hydraulic, electromagnetic or electric drives, can be used.

In addition to the main air inlet, the intake system also has auxiliary air inlet, which, on the one hand, has an inlet opening, and, on the other hand, is connected so as to communicate with the clean air line adjoining the air filter. The inlet opening is disposed at a moisture protected location. Furthermore, in particular designs the inlet opening can be arranged downstream of a water separator. In addition, the inlet opening of the auxiliary air inlet can be arranged at a higher position relative to the inlet opening of the main air inlet. Examples of suitable moisture protected places in a motor vehicle include, for example, the engine compartment or the ventilation system for the passenger compartment. As soon as the main air inlet is closed, air can flow into the intake system through this auxiliary air inlet. The cross section of the auxiliary air inlet can be greater than, equal to or smaller than that of the main air inlet. If the cross section of the auxiliary air inlet is smaller than that of the main air inlet, then due to the larger air resistance of the auxiliary air inlet, it can always remain unblocked or open, since when the main air inlet is open, the air will always flow into the intake system through the main air inlet with its larger cross section and smaller air resistance. In one advantageous design, the auxiliary air inlet is designed to be at least partially closeable, in which case the valve which is arranged in the main air inlet, can also serve to close the auxiliary air inlet. In other designs a separate blocking element to close the auxiliary air inlet can also be provided.

In accordance with one advantageous design, the other sensor, which is arranged outside the intake system, is a rain sensor, which is mounted, for example, on a windshield of a motor vehicle and detects striking rain drops or wet or moist snow. The sensor can also be connected to a windshield wiper of a motor vehicle and detect the actuation of the window wiper. The rain sensor transmits a signal, which can be used in the evaluating unit to confirm the signal from the moisture sensor from the main air inlet. In this respect there are four variant relationships.

First variant: The moisture and rain sensors both report no water, in which case the control signal of the evaluating unit opens or holds open the main air inlet, and air can flow through said main air inlet into the intake system.

Second variant: The moisture and rain sensors both report water, in which case the control signal of the evaluating unit closes the main air inlet, and the air must flow through the auxiliary air inlet into the intake system.

Third variant: The moisture sensor reports water but the rain sensor reports no water. In this variant, for example, the main air inlet can be partially closed so that moist air from the main air inlet is mixed with dry air from the auxiliary air inlet. In particular embodiments the mixing ratio can be subsequently controlled when the moisture sensor continues to report water. This subsequent control can result in complete closure of the main air inlet.

Fourth variant: The moisture sensor reports no water, but the rain sensor reports water. In this variant the main air inlet can be closed as a precaution, but can also remain open. This decision can be defined, for example, in the specifications of the internal combustion engine manufacturer.

It is advantageous that the sensor, which is disposed outside the intake system, be a moisture sensor to detect an environmental state. In doing so, the moisture sensor may advantageously be arranged, for example, on a bumper or in a wheel well of a motor vehicle. Thus, the environmental state, for example of the street, on which the vehicle is driving, can be detected. The signal of this moisture sensor, arranged outside the intake system, is correlated or linked in the evaluating unit with the signal of the moisture sensor disposed in the main air inlet. The interconnection of these two sensors yields four variants, which can be used to open, partially or fully close the main air inlet, depending on the sensed conditions. Other variants make it possible to connect the two moisture sensors to the rain sensor, thus producing better logic to control the valve.

In another embodiment of the invention, the sensor disposed outside the intake system is a float, which is provided to detect the environmental state. This float reacts to water impact, when, for example, a wave of water reaches the intake system or the internal combustion engine or a motor vehicle drives through a body of water. The float signal is linked to the signal of the moisture sensor, disposed in the main air inlet, whereby other signals from other sensors can also be interlinked.

It is advantageous if the other sensor, which is arranged outside the intake system, is provided to detect characteristics of the internal combustion engine, especially the engine speed, temperature and/or rate of air flow. Due to the linking of the characteristics of the internal combustion engine with the signal of the moisture sensor disposed in the main air inlet, the valve for closing the main air inlet can be controlled in such a manner that no abrupt changes in the air supply will ensue for the internal combustion engine. If, for example, the internal combustion engine drives a motor vehicle at full load, and the air supply in the intake system is abruptly changed from the main air inlet to the auxiliary air inlet, there will be an adverse impact on the driving comfort, since a jolt can be perceived in the passenger compartment. In this respect, a slow change in the air supply from the main air inlet to the auxiliary air inlet improves the driving comfort. To the extent that a slow change-over in the air supply can be realized, an attempt should be made to achieve it. In the case of environmental influences, such as Water impact, which result in damage to the internal combustion engine or other components, an abrupt change-over to protect the internal combustion engine or other moisture sensitive components is necessary, in which case a temporary decrease in driving comfort can be accepted.

Due to the linking of the signal from the moisture sensor, disposed in the main air inlet, with, for example, the operating temperature of the internal combustion engine, the cold start can be shortened by taking in warm air from an engine compartment, in which the internal combustion engine is disposed. This cold start phase, which, from the start of the internal combustion engine, takes a defined period of time, can also be time-controlled.

In accordance with another embodiment, the other sensor with which the moisture sensor in the intake system is linked, comprises a pressure sensor for detecting ambient air pressure.

It is also advantageous if the other sensor, which is disposed outside the intake system and is connected to the evaluating unit, is a velocity sensor for detecting vehicle speed. In the evaluating unit the signal of the moisture sensor disposed in the main air inlet, is linked to the signal of the velocity sensor, in which case a switching logic is installed in the evaluating unit which takes into account both the driving comfort and the protection of the internal combustion engine and the other components.

In a process for operating the intake system, the signal of the moisture sensor disposed in the main raw air intake in the evaluating unit is linked with at least one other signal of the sensor disposed outside the intake system. According to the requirements of the intake system and the internal combustion engine, the switching logic, disposed in the evaluating unit, can control the valve, whereby, of course, the valve is also regulated. The result of interlinking several signals is an accurate and reliable closing of the main air inlet, whereby unnecessary closings due to the consideration of external sensor signals are prevented. Furthermore, the closing events can be adapted to the respective situation of a motor vehicle, such as velocity, revolutions, temperature.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
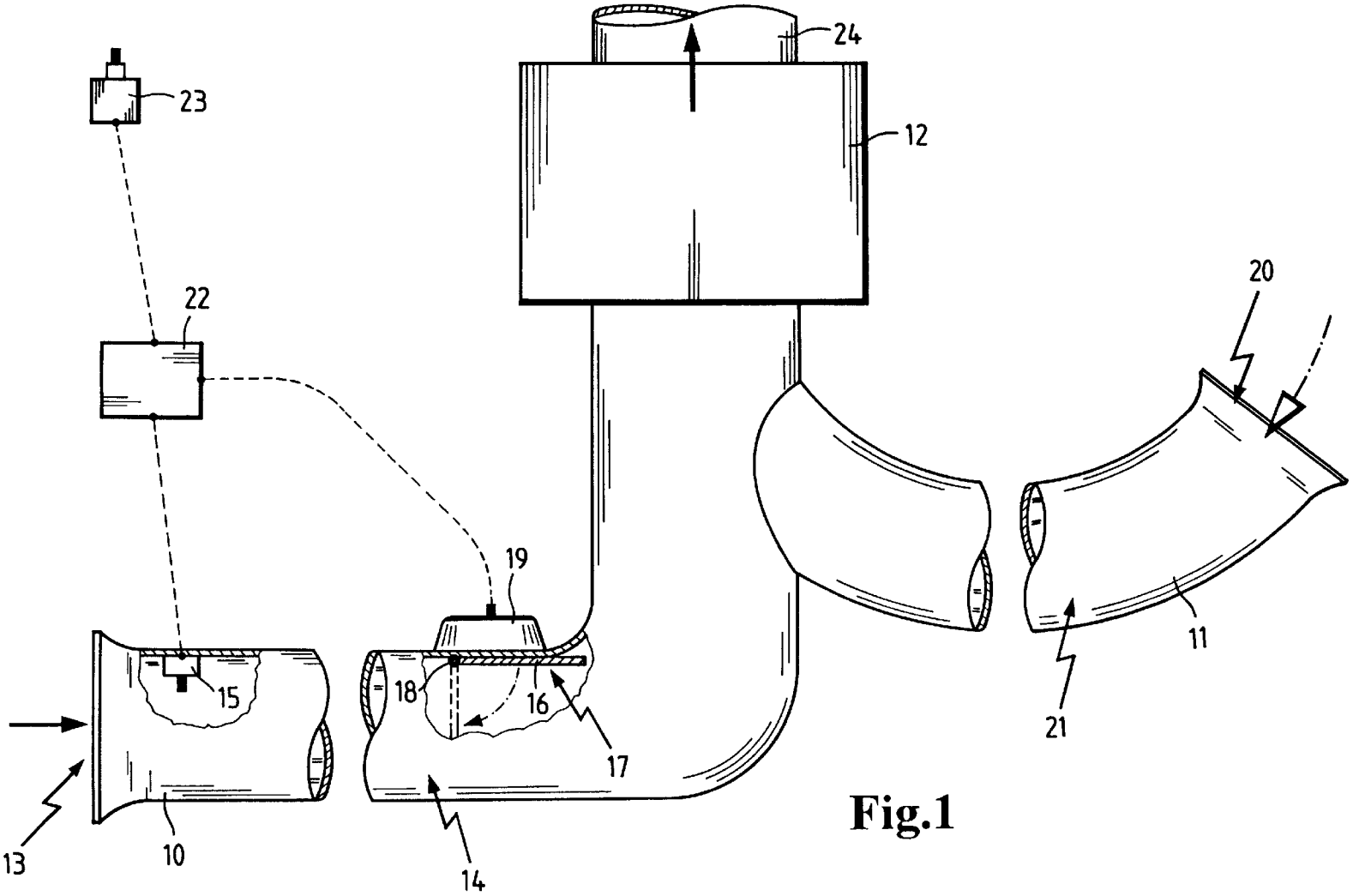
FIG. 1 shows an intake system according to the invention.

FIG. 1 is a schematic drawing of an intake system. The intake system exhibits a main air inlet 10, an auxiliary air inlet 11, and an air filter 12. The main air inlet 10 is formed by means of an opening 13 with a line segment 14, adjoining this opening 13. In the line segment 14 there is a moisture sensor 15 and a valve 16, whereby the moisture sensor 15 is arranged between the opening 13 and the valve 16. In this embodiment the valve 16 is designed as a rotary disk valve 17, which rotates about an axis 18, arranged in a peripheral area of the rotary disk valve 17. The rotary disk valve 17 is moved by a vacuum cell 19. In the first switching position the rotary disk valve 17 rests against the line segment 14, whereby the main air inlet 10 is opened. In a second switching position, the rotary disk valve 17 completely closes the line segment 14 (as shown in broken lines).

The auxiliary air inlet 11 has an inlet opening 20 and a pipe segment 21, adjoining the inlet opening 20. The inlet opening 20 is arranged in a place, protected against moisture, whereby the inlet opening 20 is arranged higher in relation to the opening 13 of the main air inlet 10. The auxiliary air inlet (11) empties between the rotary disk valve 17 and the air filter 12 into the line segment 14.

The moisture sensor 15 is connected to an evaluating unit 22, in which the signal, coming from the moisture sensor 15, is linked with a sensor signal of a rain sensor 23, which is also connected to the evaluating unit 22. The rain sensor 23 is disposed outside the intake system and is provided for the purpose of detecting rain drops, a function that is not directly related to the intake system. In accordance with the logic disposed in the evaluating unit 22, the evaluating unit 22 sends a control signal to the vacuum cell 19, by means of which the valve 16 is moved and the main air inlet 10 is closed or opened.

| Control signal | Moisture sensor signal | Rain sensor signal |
|---|---|---|
| Main air inlet open | no water | no water |
| Main air inlet closed | water | water |
| Main air inlet half closed | no water | water |
| Main air inlet closed | water | no water |

In the first switching position of the valve 16 the main air inlet 10 is opened, whereby the intake air for an internal combustion engine (not shown) flows in the direction of the arrow through the opening 13 into the intake system. The intake air is guided in the line segment 14 to the air filter 12, where it is cleaned. The cleaned intake air is guided in a clean air line 24 to the internal combustion engine (not shown). Since the cross section of the line segment 14 is larger than the cross section of the pipe segment 21, the intake air flows through the larger cross section of the line segment 14 into the intake system.

In the second switching position of the valve 16, the main air inlet 10 is closed, in which case the intake air for the internal combustion engine flows in the direction of the broken line through the inlet opening 20 into the intake system.

In the third switching position of the valve 16 the main air inlet 10 is half closed, in which case air flows through the main air inlet 10 and also through the auxiliary air inlet 11 into the intake system.

Figure 2:
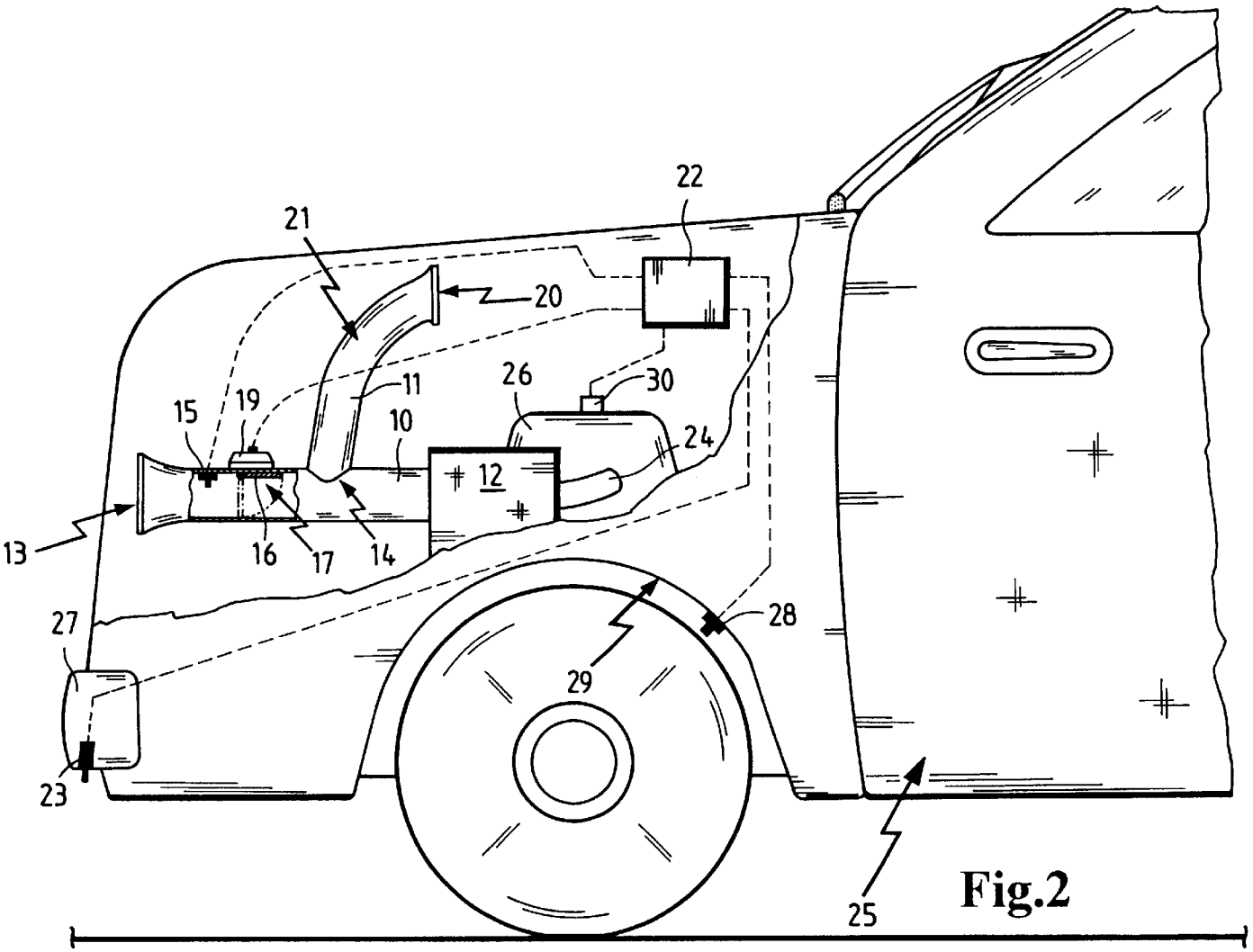
FIG. 2 is a schematic drawing of the intake system in a motor vehicle.

FIG. 2 is a schematic drawing of an intake system in a motor vehicle 25. The components that correspond to those in FIG. 1 are identified by the same reference numerals. The opening 13 of the main air inlet 10 is disposed in the front area of the motor vehicle 25. In order that no water, which enters through the opening 13 into the intake system, will penetrate as far as up to an internal combustion engine 26, a valve 16 is arranged in the main air inlet 10. The valve 16 is controlled by a switching logic, which resides in the evaluating unit 22.

In this embodiment not only the moisture sensor 15, disposed in the main air inlet 10, and the rain sensor 23, which is disposed in a bumper 27, but also other sensors are connected to the evaluating unit 22. One of these sensors is a second moisture sensor 28, which is disposed in a wheel well 29 of the motor vehicle 25. Furthermore a multisensor 30, which detects the state of the internal combustion engine 26, is connected to the evaluating unit 22. This multisensor 30 sends, for example, revolutions, driving velocity, operating temperature and load state of the internal combustion engine 26 to the evaluating unit 22, where optimal control of the valve 16 is produced by linking all of the sensor signals together. In doing so, both the driving comfort for the passengers and also the operating reliability of the internal combustion engine is taken into consideration.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An air intake system for an internal combustion engine of a motor vehicle, comprising a main air inlet, a moisture sensor, an evaluator, a valve, an air filter, and an auxiliary air inlet; wherein the main air inlet comprises an inlet opening arranged at an advantageous location for air intake and is connected to communicate with the air filter; a clean air line is arranged downstream of the air filter and connected to communicate with the internal combustion engine; the moisture sensor has a signal output connected to communicate with the evaluator; the valve is movably arranged in the main air inlet so as to selectively open or close the main air inlet and is connected so as to communicate with the evaluator; the auxiliary air inlet is arranged at a moisture protected location and communicates with the clean air line; the moisture sensor is arranged in the main air inlet in such a manner that moisture entering the main air inlet can be sensed, and the evaluator is connected to communicate with at least one other sensor arranged outside the intake system and provided to detect and signal other functions, and the evaluator produces a switching logic which controls the valve in response to the signal of the moisture sensor together with the signal of the other sensor.

2. An air intake system according to claim 1, wherein said other sensor is a rain sensor.

3. An air intake system according to claim 1, wherein said other sensor is a moisture sensor for detecting an environmental state and which is disposed on a bumper of a motor vehicle.

4. An air intake system according to claim 1, wherein said other sensor is a float for detecting an environmental state outside the intake system.

5. An air intake system according to claim 1, wherein said other sensor detects a condition of the internal combustion engine.

6. An air intake system according to claim 5, wherein the internal combustion engine condition is selected from the group consisting of rotational speed, temperature and air flow rate.

7. An air intake system according to claim 1, wherein said other sensor is an ambient air pressure sensor.

8. An air intake system according to claim 1, wherein said other sensor is velocity sensor for sensing motor vehicle speed.

9. An air intake system according to claim 1, wherein the auxiliary air inlet is at least partially closeable.

10. An air intake system according to claim 1, wherein the switching logic of the evaluator controls the valve between a first switching position in which the main air inlet is fully open, a second switching position in which the main air inlet is completely closed, and a third switching position in which the main air inlet is partially open.

11. A process for operating an intake system of an internal combustion engine comprising:

sensing the presence or absence of moisture in air drawn through a main air intake into the intake system;

sensing a condition outside said air intake system;

transmitting signals representative of the presence or absence of moisture in the main air intake and of the outside condition to an evaluator, processing said signals in said evaluator in accordance with a valve switching control logic which produces a valve position control signal, and controlling the position of a valve in said main air intake in accordance with said valve control signal to open or shut said main air intake.

12. A process according to claim 11, wherein the switching logic of the evaluator controls the valve between a first switching position in which the main air intake is fully open, a second switching position in which the main air intake is completely closed, and a third switching position in which the main air intake is partially open.

13. A process according to claim 12, wherein the outside condition is an environmental condition selected from the group consisting of rain, ambient air pressure and vehicle speed.

14. A process according to claim 12, wherein the outside condition is an the internal combustion engine condition selected from the group consisting of rotational speed, temperature and air flow rate.

* * * * *